United States Patent [19]

Kokubun et al.

[11] Patent Number: 4,676,398

[45] Date of Patent: Jun. 30, 1987

[54] DISPENSING MECHANISM FOR VENDING MACHINES

[75] Inventors: Yoshikazu Kokubun, Shin; Akihito Kurosawa; Osamu Anazawa, both of Maebashi; Daigo Sunouchi; Masayuki Yoshihara, both of Isesaki, all of Japan

[73] Assignee: Sanden Corporation, Gunma, Japan

[21] Appl. No.: 814,796

[22] Filed: Dec. 30, 1985

[30] Foreign Application Priority Data

Dec. 28, 1984 [JP] Japan ..... 59-196711[U]

[51] Int. Cl.[4] ..... G07F 11/10

[52] U.S. Cl. ..... 221/129; 221/131

[58] Field of Search ..... 221/13, 126, 127, 128, 221/129, 131

[56] References Cited

U.S. PATENT DOCUMENTS 3,998,357 12/1976 Levasseur ..... 221/129 X 4,542,834 9/1985 Kurosawa et al. ..... 221/116

4,552,285 11/1985 Luscher ..... 221/13

*Primary Examiner*—F. J. Bartuska

*Attorney, Agent, or Firm*—Banner, Birch, McKie & Beckett

[57] ABSTRACT

An article dispenser for dispensing articles from a vending machine is disclosed. The article dispenser includes an article storage area which has a bottom opening through which articles are dispensed and an article dispensing mechanism which dispenses the lowermost articles stacked in the storage area through the bottom opening. The dispensing mechanism includes a rotating shaft which controls the opening and closing of the bottom opening of the storage area and is driven by a motor. The motor is controlled by a control device which rotates the motor in a first direction as determined by selection switches and reverses the direction of the motor after it has rotated 90° and returns the motor to its initial starting position.

3 Claims, 12 Drawing Figures

+12V
+24V
M
23
36
37
38
39
X1
X2
X3
X4
A1
A2
A3
A4
KA
B1
B2
B3
B4
KB
307
34
35
33
305
306
308
309
302
303
304
31
32
301
40
22a
22b
30

DISPENSING MECHANISM FOR VENDING MACHINES

BACKGROUND OF THE INVENTION

This invention relates to the field of vending machines, and more particularly, is directed to an improved dispensing mechanism for a vending machine.

Various types of dispensing mechanisms for vending machines have been used in the prior art depending on the type of food products or goods being vended. One well known type of dispensing mechanism uses a flapper device. This type of dispensing mechanism is adapted to dispense rectangular or cube shaped paper cartons containing a beverage or other liquid.

The basic construction of a flapper type dispensing mechanism is shown in U.S. Pat. No. 4,542,834. This type of dispensing mechanism includes a rotating shaft which vertically extends into the storage area of the vending machine to divide the storage area into two vertical rows or columns stacked with vending articles. A control plate is fixed on the lower end of the rotating shaft and controls the operation of a pair of flappers positioned below the two vertical rows of articles. As the flappers open and close upon rotation of the shaft, the lowermost article in the rows are dispensed.

In this construction of a flapper type dispensing mechanism, the direction of rotation of the rotating shaft is predetermined, i.e., the rotating shaft is only rotated in one direction and cannot be reversed. Therefore, the articles stored in the two rows are alternately dispensed due to the opening and closing operation of the flappers. Thus, the same kind of articles should be stored in the vending machine. However, if several kinds of articles are to be vended, a plurality of different dispensing mechanisms are required depending upon the kinds of articles.

SUMMARY OF THE INVENTION

It is a primary object of this invention to provide a simple dispensing mechanism for vending machines in which a plurality of different kinds of articles can be stored and dispensed.

It is another object of this invention to provide a dispensing mechanism for vending machines wherein the operation of the rotating shaft which controls dispensing of articles is controlled by a simple control device.

A dispensing mechanism for vending machines according to this invention includes an article storage area for storing articles in a stacked position above a bottom opening through which one or more articles are dispensed. The dispensing mechanism includes a pair of flappers which are rotatably supported at the lower end of the storage area and are disposed for covering the bottom opening of the storage area. A control plate is attached to the lower end of a motor driven rotating shaft and contacts the back surface of the flappers to control the pivoting of the flappers upon rotation of the rotating shaft. A control device for controlling the operation of the rotating shaft comprises a first position detecting device which determines whether the rotating shaft is in the waiting position, a second position detecting device which determines whether either one of the flappers is released, article selecting switches and a motor control device. The motor control device operates the motor to rotate the rotating shaft after one of the article selecting switches has been operated. After a signal is received from the second position detecting device, the direction of rotation of the motor is reversed until a signal is received from the first position detecting device.

Further objects, features and other aspects of this invention will be understood from the following detailed description of the preferred embodiment with reference to the annexed drawings.

BRIEF DESCRIPTION OF THE DRAWINGS

FIG. 8(*b*) is a sectional view taken along line 8*b*—8*b* in FIG. 8(*a*).

FIG. 9(*b*) is a sectional view taken along line 9*b*—9*b* in FIG. 9(*a*).

DETAILED DESCRIPTION OF THE PREFERRED EMBODIMENTS

Figure 1:
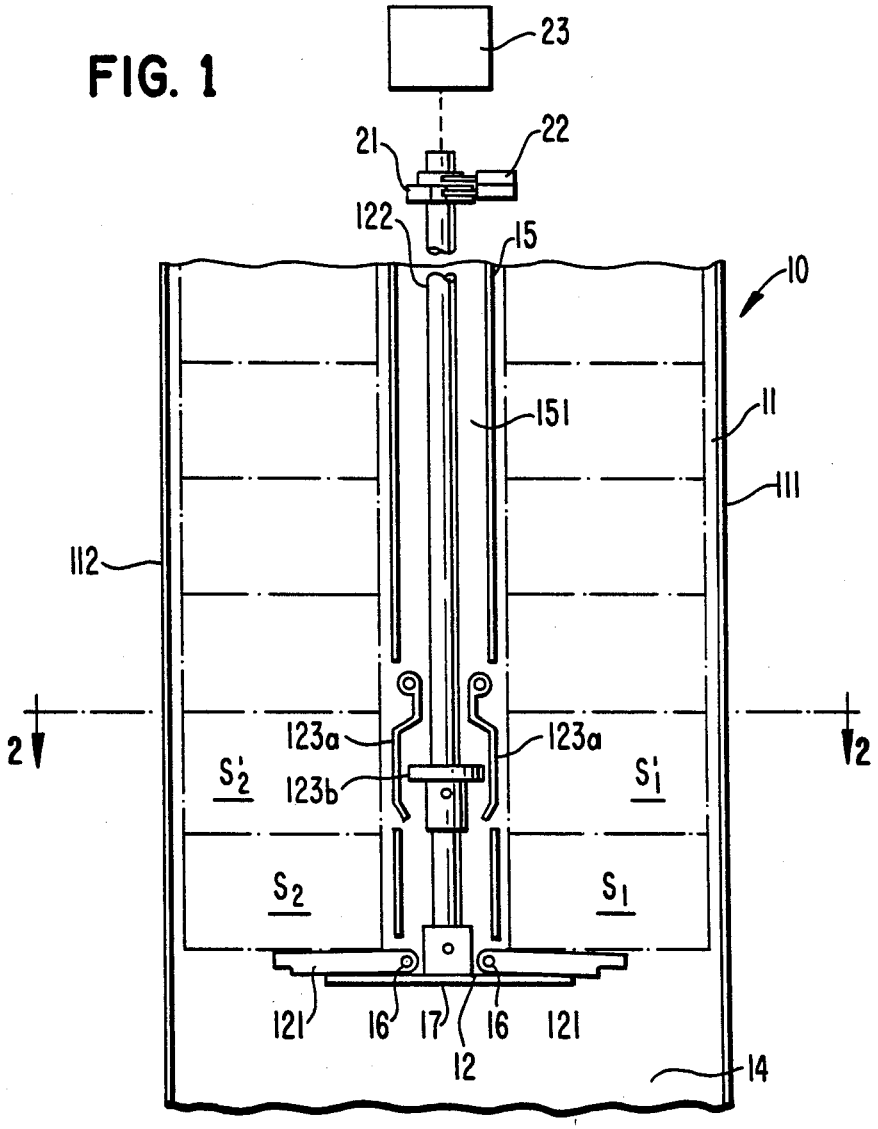
FIG. 1 is a partial front end view of an article dispensing mechanism including a control mechanism according to the present invention.
Figure 2:
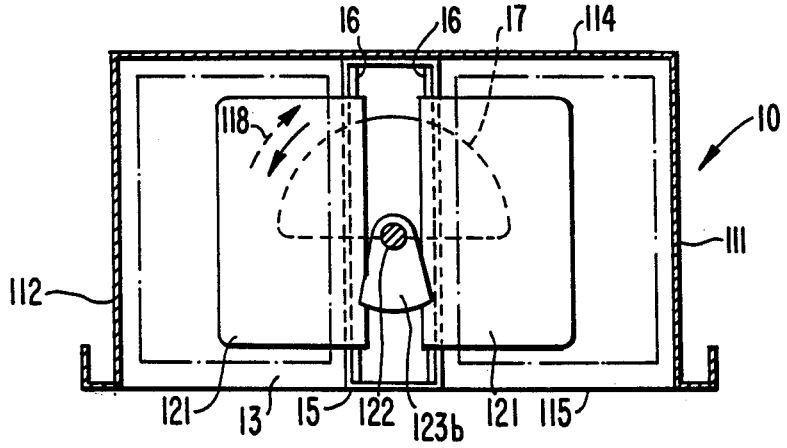
FIG. 2 is a sectional view taken along line 2—2 in FIG. 1.

Referring to FIGS. 1 and 2, a dispensing unit 10, including a motor control device in accordance with the present invention, is shown. The dispensing unit 10 includes article storage area 11 and article dispensing mechanism 12. Article storage area 11 comprises vertically disposed side plates 111, 112, an upper plate (not shown) and a back plate 114, each of which is connected with one another to form a U-shaped cross-section as shown in FIG. 2. Front support plate 115 is connected across the lower front portion of side plates 111, 112. Front opening 13, which is formed between side plates 111, 112, and the upper plate (not shown) and support plate 115, is used to load articles into storage area 11. Storage area 11 has a bottom discharge opening 14 through which articles are dispensed. Storage area 11 is also divided into two vertical columns by divider plate 15 which vertically extends through the center portion of storage area 11 and has a rectangular shaped space 151 therein. Thus, the articles S are stored in the columns formed on both sides of divider plate 15.

Article dispensing mechanism 12 is disposed within article storage area 11 and comprises a pair of rectangularly shaped flappers 121, rotating shaft 122, holding apparatus 123 and a driving mechanism for rotating shaft 122. Each of flappers 121 is pivotably supported by a hinge element 16 which is removably disposed on front plate 115 and back plate 114, respectively, below divider plate 15. As shown in FIG. 1, flappers 121 are disposed in discharge opening 14 of storage area 11, i.e., flappers 121 are positioned below each of the columns formed by divider plate 15 to control the opening and closing of discharge opening 14.

Rotating shaft 122 vertically extends into space 151 of divider plate 15. The lower end portion of rotating shaft 122 is rotatably supported by a support element which is fixed to and extends from the inner surface of back plate 114. The upper end portion of rotating shaft 122 is connected to a driving mechanism which is disposed on the upper plate and includes a motor 21 for driving rotating shaft 122.

Rotating shaft 122 has an arc shaped control plate 17 at its lower end portion. Control plate 17 contacts the lower or back surface of flappers 121. When control plate 17 is in engagement with the lower surface of both flappers 121, the flappers are forced in a horizontal position. Thus, control plate 17 controls the pivoting of flappers 121 to prevent discharge of any articles from storage area 11. When control plate 17 is rotated by the operation of rotating shaft 122 to contact only one of flappers 121, the other flapper pivots to an open position to permit discharge of an article from the column over the respective flapper (see FIG. 3).

Figure 3:
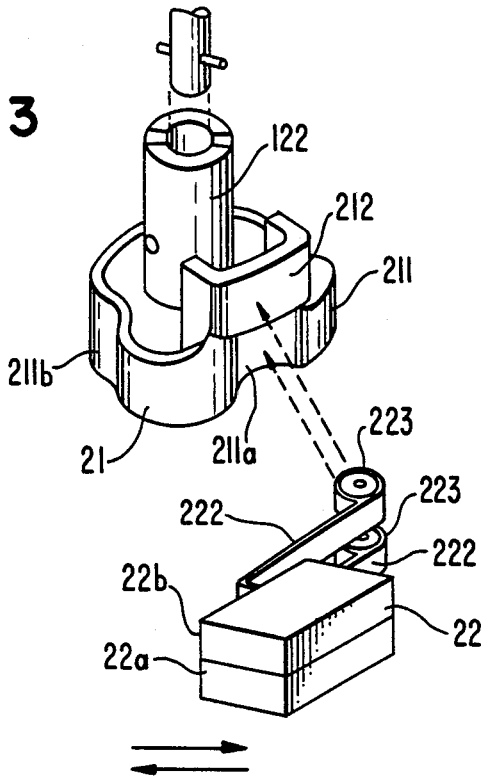
FIG. 3 is an exploded perspective view of the driving mechanism for the rotating shaft used in the dispensing mechanism in FIG. 1.
Figure 4:
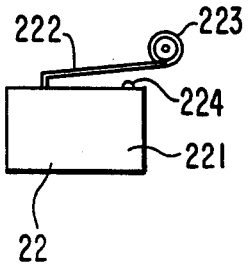
FIG. 4 is a side view of the switch element used in the driving mechanism of FIG. 3.

Holding apparatus 123, which comprises a pair of levers 123*a*, is pivotably supported within space 151 of divider plate 15. An arc shaped pushing element 123*b* is attached to rotating shaft 122 and is disposed in article storage area 11 at a position adjacent the lower portion of driving shaft 122. As shown in FIG. 2, holding apparatus 123 is aligned with articles $S_1'$, $S_2'$ which are stacked above lowermost articles $S_1$, $S_2$ on the upper surface of flappers 121. As shown in FIG. 3, one or the other of flappers 123*a* is pushed against a respective article $S_1'$ or $S_2'$ by the rotation of pushing element 123*b* driven by rotating shaft 122. Thus, article $S_1'$ or $S_2'$ stacked above the dispensing article $S_1$ or $S_2$ can be held in position by the operation of holding apparatus 123.

Referring to FIG. 3, cam portion 21 of the driving mechanism, which is attached to the upper end of rotating shaft 122, comprises a first cam portion 211 and a second cam portion 212. Cam portion 212 is placed on the upper portion of the driving mechanism and is integrally formed with first cam portion 211. First cam portion 211 has a circular-shaped cross section and is formed with three depression 211*a*, 211*b* and 211*c* at its outer peripheral surface. Two depressions 211*b*, 211*c* are formed on the right and left sides of depressions 211*a* at a 90° offset. The outer peripheral surface of second cam portion 212 lies in the same plane as first cam portion 211 and is placed above the central positioned depression 211*a*. The radial width of second cam portion 212 is larger than the radial width of central positioned depression 211*a*.

Two switch elements 22*a*, 22*b* are disposed around the cam portion 21. These switch elements comprise a body portion 221 which includes a switching terminal (not shown), a plate element 222 formed of spring material and supported on body portion 221 at one of its ends, a roller element 223 fixed on the outer end of plate element 222 and projection 224 which is movably disposed on body element 221 to control the operation of the switching terminal. Roller element 223 of first switch element 22*a* is in engagement with the outer peripheral surface of first cam portion 221 and roller element 223 of second switch element 22*b* is in engagement with second cam portion 212.

Figure 5:
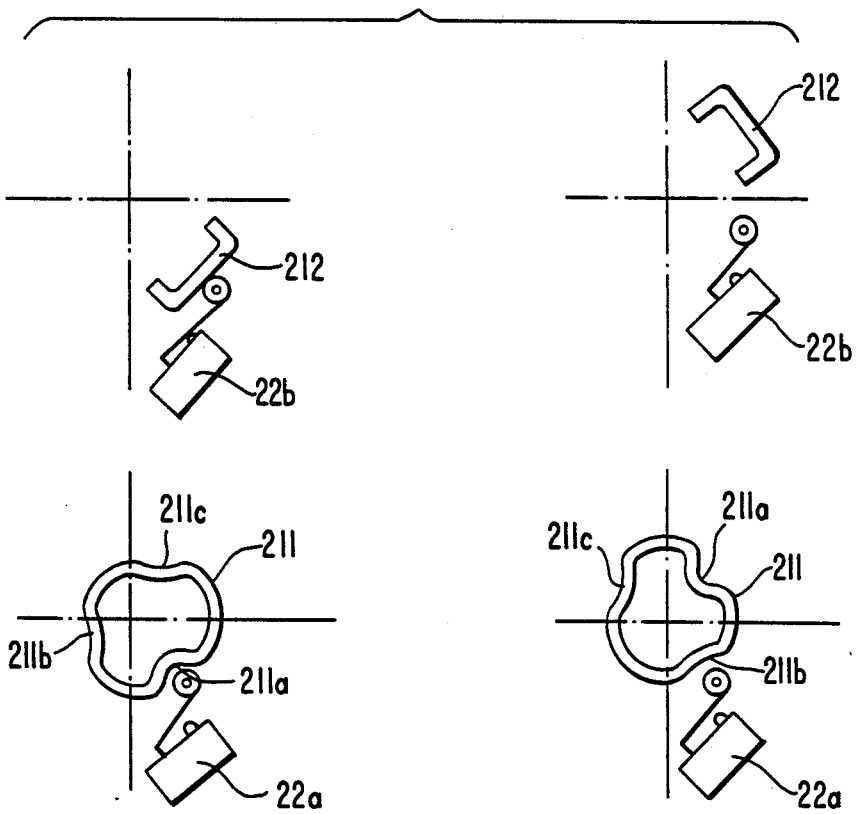
FIG. 5 is a diagrammatic view illustrating the operation of the driving mechanism of FIG. 3.

The operation of article dispensing mechanism 12 is controlled by switch elements 22*a* and 22*b* as shown in FIG. 5. In the waiting or quiescent condition of the vending machine, roller element 223 of second switch element 22*b* is in engagement with the outer surface of second cam portion 212 to provide an output ON signal for second switch element 22*b*. Roller element 223 of first switch element 22*a* is in engagement with the central positioned depression 211*a* to provide an OFF signal for first switch element 22*a*. When cam portion 21 is rotated in either direction by rotating shaft 122, roller element 223 of second switch element 22*b* disengages from cam portion 212 and second switch element 22*b* outputs an OFF signal. First switch element 22*a* also outputs an OFF signal.

Figures 6A, 6B:
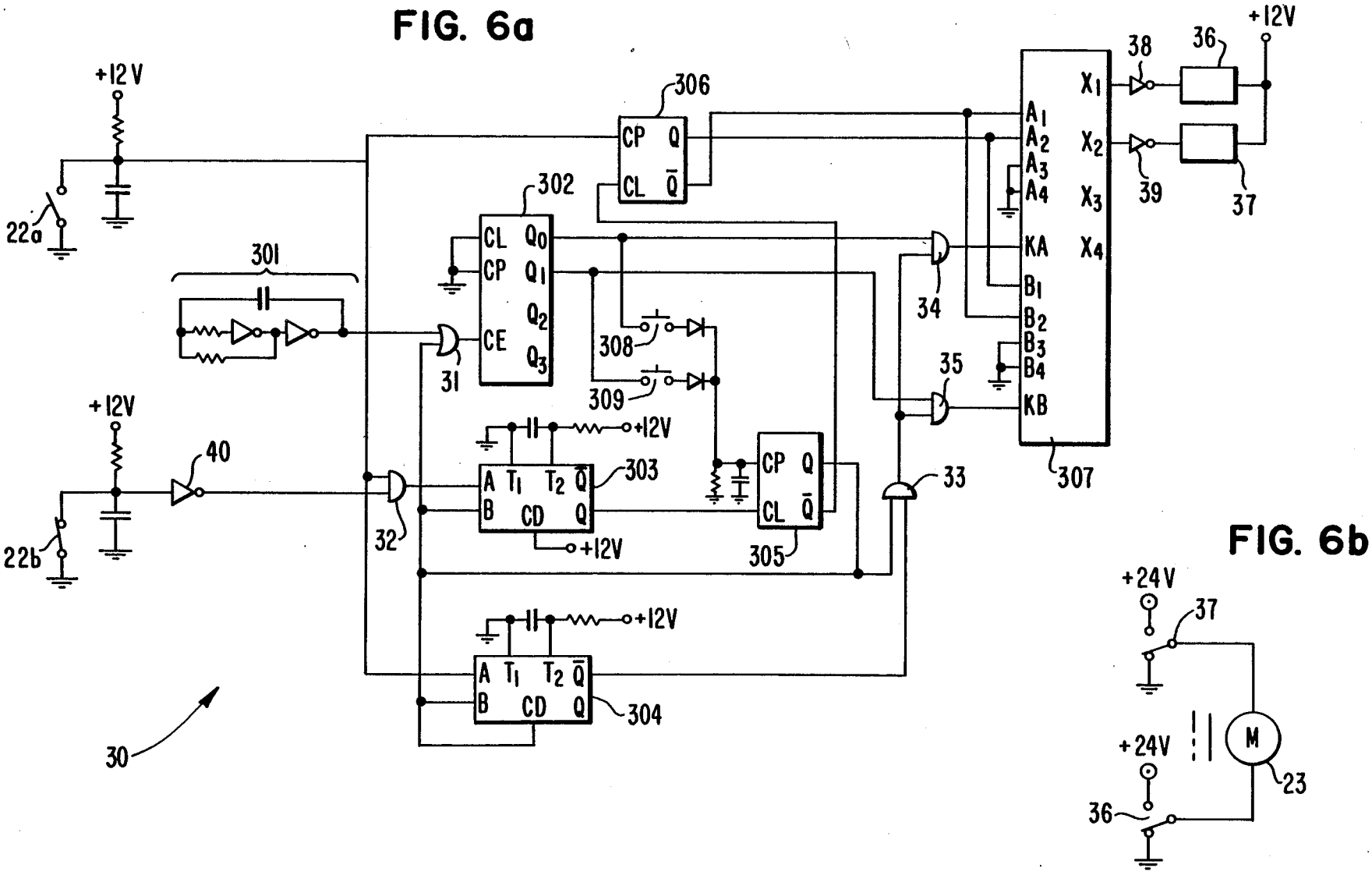
FIGS. 6*a* and 6*b* are circuit diagrams of the control device for the driving mechanism according to the present invention.

Referring to FIG. 6*a*, a control device for motor 23 according to one embodiment of this invention will be described. Control device 30 comprises a pulse generator 301, counter 302, two timer circuits 303, 304, two flip-flop circuits 305, 306, logic OR gate 307 and two selecting switches 308, 309.

When a logic HI level signal is provided to the "CP" input terminal of flip-flops 305, 306, the output signal from "Q" terminal of the flip-flops changes to a logic HI level. While a logic LO level is present on the "A" input terminal of timer circuit 303, 304, if the input signal on the "B" terminal of the timer circuits changes from a logic HI level to a logic LO level, the "Q" terminal outputs a logic HI level.

The "$Q_0$" and "$Q_1$" output terminals of counter 302 outputs pulse signals by a predetermined cycle according to the pulse signal present at the "CE" terminal of counter 302. While a logic HI level is present on the "KA" terminal of selector circuit 307 through AND gate 34, if a logic HI is present on each of the "A" terminals, the output signal on the corresponding "X" terminals change to a logic HI. Also, a logic HI is present on the "DK" terminal, the signals on the "X" terminals change to the signals on the "B" terminals.

Figure 7:
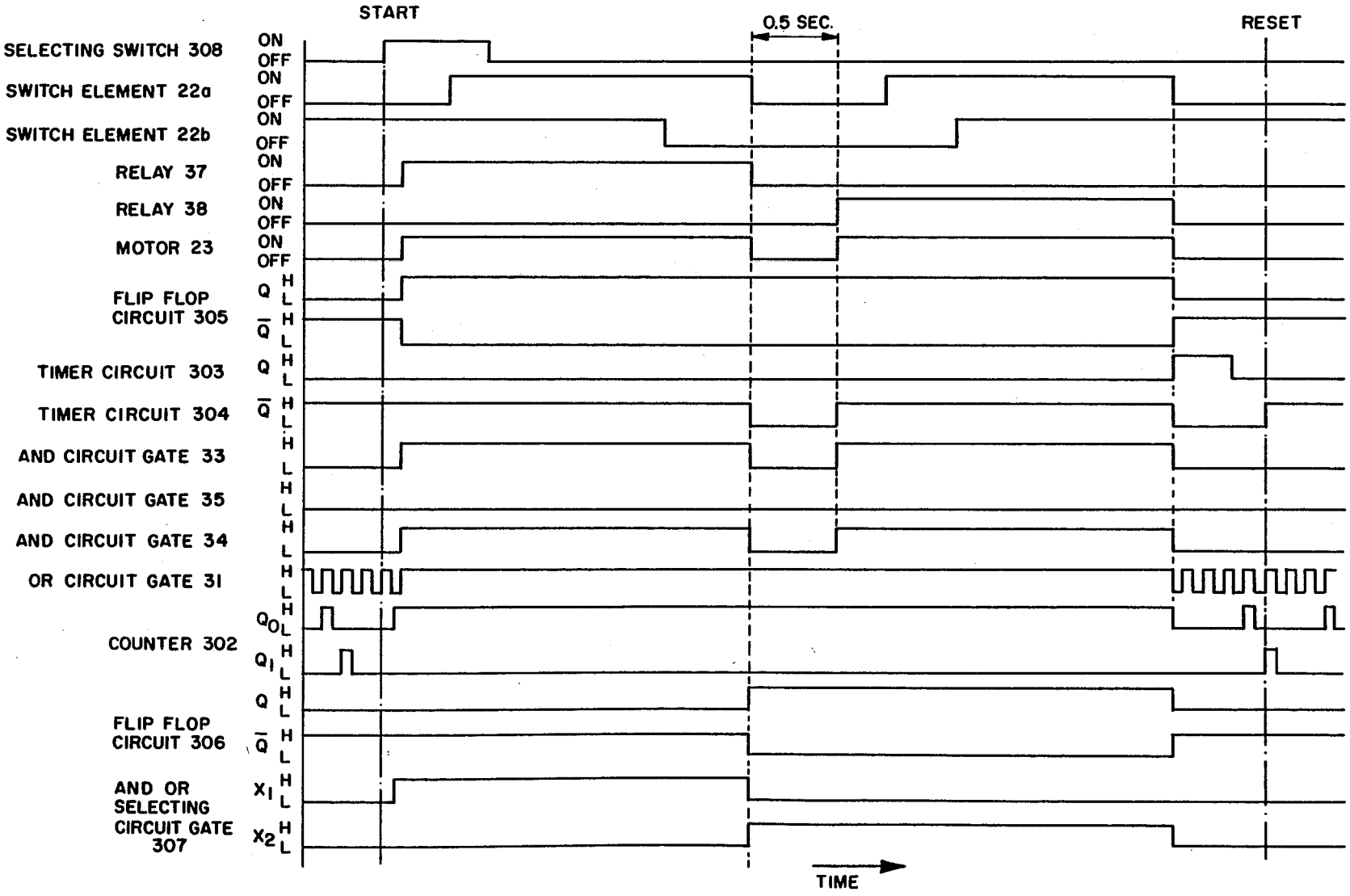
FIG. 7 is a time-line chart illustrating the signals at several points in the circuit shown in FIGS. 6*a* and 6*b*.

The operation of the above mentioned control device 30 will be explained with reference to FIGS. 6*a*, 6*b* and 7. The pulse signal generated by pulse generator 301 is supplied to the "CE" terminal of counter 302 through OR gate 31. Thus, a pulse signal is output from the "$Q_0$" and "$Q_1$" terminals in a predetermined cycle. Under this condition, if selecting switch 308 is closed in accordance with a selection of an article by the vending machine customer, the pulse signal output from the "$Q_0$" terminal of counter 302 is input on the "CP" terminal of flip-flop circuit 305. Thus, the output from the "Q" terminal is a logic HI level and the output from the "Q" terminal is input to OR gate 31. As a result of the logic HI level at the input of OR gate 31, the "CE" terminal of counter 302 is changed to a logic HI level to thereby fix the output signal of the "$Q_0$" terminal to a logic HI.

When the vending machine is waiting to dispense an article, i.e., waiting for one or the other of selecting switches 308, 309 to be activated, first switch element 22*a* is open and second switch element 22*b* is closed as shown in FIG. 3. During this time, the output from inverter 40 is at a logic HI level. Therefore, the "CP" terminal of flip-flop 305 and the "A" terminals of timer circuits 303, 304 are at a logic HI level. Furthermore, the "B" and "CD" terminals of timer circuit 304 and the "B" terminal of timer circuit 303 are also at a logic HI level. Thus, the "Q" terminal of first timer circuit 303 is at a LO logic level and the "$\overline{Q}$" terminal of timer circuit 304 is at a HI logic level.

Since the "A" terminal of timer circuit 303 outputs a logic HI level signal, flip-flop 305 does not reset. Therefore, AND gate 33 outputs a logic HI level signal. Also, AND gate 34 outputs a logic HI level signal and AND gate 35 outputs a logic LO level signal because the "$Q_0$" terminal of counter 302 outputs a logic HI level signal and the "$Q_2$" terminal of counter 302 outputs a logic LO level signal. Furthermore, even if a logic HI level signal is input to the "CP" terminal of flip-flop 306, the output signal from the "Q" terminal changes to a logic LO level signal and the "$\overline{Q}$" terminal changes to a logic HI level signal. As a result of the output from flip-flop 306, a HI logic level signal is input to the "$A_1$" terminal of selecting circuit 307 and a logic LO level signal is input to the "$A_2$" terminal of selecting circuit 307. Therefore, a logic HI level signal is output from the "$X_1$" terminal and a logic LO level signal is output from the "$X_2$" terminal. The output signal from the "X" terminals are inverted by inverter 38, 39 and are then used to drive relay elements 36, 37 respectively. Relay elements 36, 37 are used to establish the direction of rotation of motor 23.

As motor 23 rotates turning shaft 122, cam portion 21 is rotated as well. During the rotation of cam portion 21, roller element 223 of switch element **22*a* is pushed outwardly following the contour of cam element 211 and turns on the switch associated with switch element 221. As a result of the switching of switch element 22*a*, the "CP" terminal of flip-flop circuit 306 and the "A" terminal of timer circuits 303, 304 receive a logic LO level signal. However, the logic outputs from flip-flop circuit 306 and time circuits 303, 304** do not change.

As shaft 122 continues to rotate, roller element 222 of switch element **22*b* moves out of contact with cam portion 212. Therefore, the switch associated with switch element 22*b* is turned off. As a result, the output signal from inverter 40** changes to a logic LO level.

When shaft 122 is rotated 90° from its original position, the roller element 223 of switch element **22*a* engages depression 211*b* of first cam portion 211. Therefore, the switch associated with switch element 22*a* turns off. When this occurs, the input signal applied to the "CP" terminal of flip-flop 306 and the "A" terminal of timer circuit 304 changes to a logic HI level. Thus, the "Q" terminal of flip-flop 306 outputs a logic HI level and the "$\overline{Q}$" terminal outputs a logic LO level. On the other hand, the "Q" terminal of timer circuit 304 changes to a logic LO level. After a predetermined time has passed (in this embodiment, 0.5 second), the output returns to a logic HI level. Therefore, if the "$\overline{Q}$" terminal of timer circuit 304 changes to a logic low level, the LO logic level signal on the "KA" terminal of selecting circuit 307 causes a low level signal to be output from the "$X_1$" and "$X_2$" terminals. Both relay elements 36, 37 thus open, thereby stopping the operation of motor 23**.

After a predetermined time has passed, such as 0.5 second, the output from the "$\overline{Q}$" terminal of timer circuit 304 changes to a logic HI level. As a result of this change, a logic HI level signal is input to the "KA" terminal of selecting circuit 307. At this time, the logic LO signal is input to the "$A_1$" terminal and a logic HI level signal is input to the "$A_2$" terminal. Therefore, the "$X_1$" terminal outputs a logic LO level and the "$X_2$" terminal outputs a logic HI level. Thus, relay element 36 closes the circuit and electricity flows as shown by the dotted line in FIG. **6*b* to rotate motor 23** in a first direction.

With reference to FIGS. **8*a* and 8*b*, when rotating shaft 122 is rotated 90°, control plate 16 is out of contact with one of flappers 121. Thus, the flapper is released from its horizontal position to open the discharge opening and article $S_1$ is dispensed from storage area 11. However, the article $S_1'$ which is stacked on the lowermost dispensing article $S_1$ is held in position by the function of holding device 123**.

As motor 23 rotates driving shaft 122, the switch associated with switch element **22*a* is turned on and the input signal on the "CP" terminal of flip-flop circuit 306 and the "A" terminal of timer circuit 304 changes to a low logic level. However, the logic output from neither flip-flop 306 or timer circuit 304 is not changed. Furthermore, during rotation of shaft 122, the switch associated with switch element 22*b* is turned on. Finally, rotating shaft 122 generates the dispensing waiting position signal and the switch associated with first switch element 22*a* is turned off. When the switch associated with first switch element 22*a* is turned off, a HI logic level is input to the "CP" terminal of flip-flop 205 and the "A" terminal of timer circuit 304. Therefore, the output from the "Q" and the "$\overline{Q}$" terminals of timer circuit 306 changes, i.e., a HI logic level is output from the "$\overline{Q}$" terminal and a LO logic level is output from the "Q" terminal. Furthermore, the output signal from the "Q" terminal of timer circuit 306 changes to a logic LO level and maintains this condition for 0.5 second. When the "$\overline{Q}$" terminal of timer circuit 304 changes to a logic LO level, the logic LO is input on the "KA" terminal of selecting circuit 307. Thus, the outputs from the "$X_1$" and "$X_2$" terminals change to a logic LO level, thereby stopping the operation of motor 23**.

When the switch associated with first switch element **22*a* is turned off, a logic HI level signal is input to the "A" terminal of timer 303. As a result, the output signal from the "Q" terminal changes to a logic HI level and is maintained in that logic state for a predetermined time, such as 0.5 second. Thus, flip-flop 305** is resest.

Figure 9A:
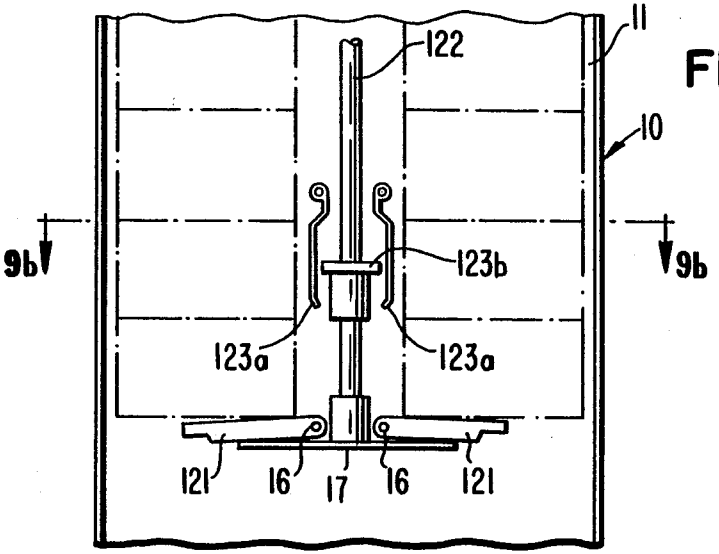
FIG. 9(*a*) is a partial front view of the article dispensing mechanism illustrating the final operating position of the dispensing mechanism after completion of a dispensing operation.
Figure 9B:
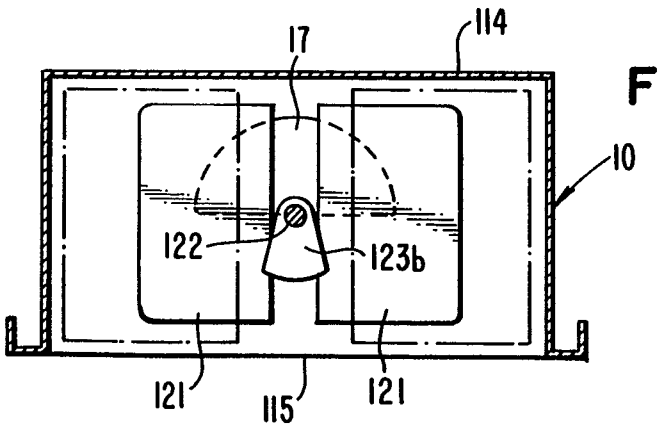
Figure 8A:
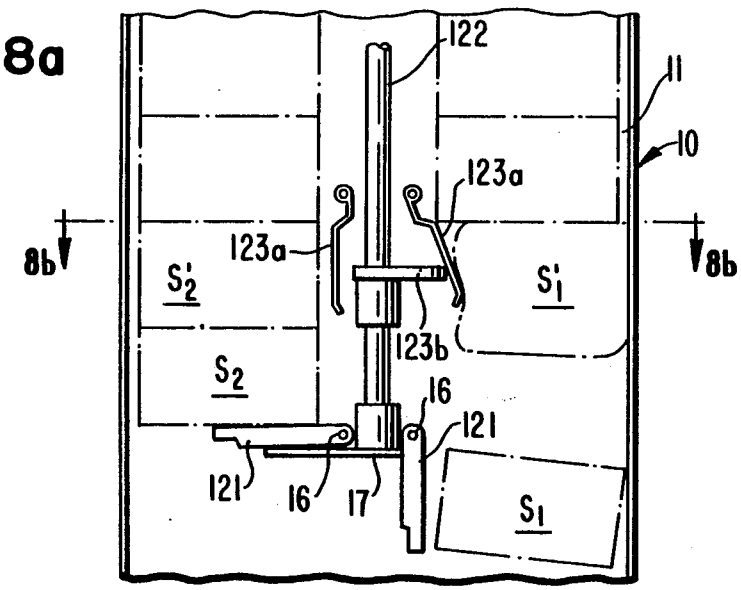
FIG. 8(*a*) is a partial front end view of the article dispensing mechanism of FIG. 1 illustrating its operation.
Figure 8B:
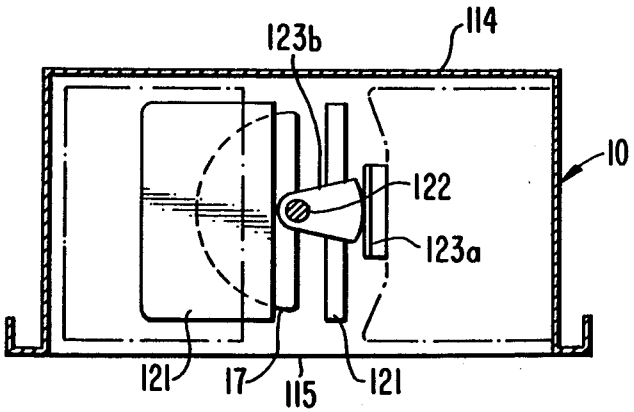

With reference to FIGS. **8*a*, 8*b*, 9*a* and 9*b*, during the reverse rotation of rotating shaft 122, control plate 16 again contacts the one released flapper 121 and pushes it upward to its former horizontal position. After rotating shaft 122 returns to its initial position, motor 23 is stopped and flapper 121 and holding device 123 are positioned in the position shown in FIGS. 9*a* and 9*b*. At this time, article $S_1'$ is released by holding device 123 and slides down to flapper 121**.

As mentioned above, the direction of rotating shaft 122 is determined by the operation of the article selecting switches and the direction of rotation of the shaft is reversed after it has rotated 90°. Therefore, either one of the articles stored in the storage area can be selectively dispensed. Thus, different kinds of articles can be stored in the vending machine and can be readily dispensed.

This invention has been described in detail in connection with the preferred embodiments. These embodiments are merely for example only and this invention is not restricted thereto. It will be easily understood by those skilled in the art that other variations and modifications can be easily made within the scope of this invention, as defined by the appended claims.

We claim:

1. In a dispensing mechanism for vending machines including an article storage area in which the articles are held in two vertically adjacent rows in a stacked disposition above a bottom opening through which the lowermost articles are dispensed and a dispensing mechanism to dispense the lowermost articles stacked in said storage area through said bottom opening, said dispensing mechanism including a rotating shaft vertically extending within said storage area between the two vertically adjacent rows, a pair of flappers pivotably supported within said storage area adjacent to the lower end of said rotating shaft to cover the bottom opening in said storage area and control plate means fixed on the lower end of said rotatable shaft in contact with the lower surface of said flappers for controlling the pivoting of each of said flappers upon rotating of said rotatable shaft to selectively open and close said flappers to dispense the lowermost stacked articles in the two vertically adjacent rows and said rotating shaft driven by a motor through control means, the improvement comprising said control means including first position detecting means for detecting the position of said rotating shaft and providing a wait signal when said shaft is in a waiting position, second position detecting means for detecting the position of said rotating shaft and providing a second detecting signal when said shaft has rotated to a predetermined position, article selecting switches and a motor control device, wherein said motor control device operates said motor to rotate said rotating shaft after one of said selecting switches is activated and after receiving a signal from said second position detecting device reverses the rotation of said motor until receiving said wait signal from said first position detecting device.

2. The dispensing mechanism for vending machines of claim 1 wherein said first position detecting device and said second detecting device includes a cam portion fixed on said rotating shaft and switch elements disposed around said cam portion.

3. The dispensing mechanism for vending machines of claim 2 wherein said cam portion comprises a first cam element and a second cam element integrally formed with one another, said first cam element having three depressions at an outer surface thereof and said second cam element being positioned above the central portion of said depressions.

* * * * *